US006731076B1

(12) United States Patent
Gerhard et al.

(10) Patent No.: US 6,731,076 B1
(45) Date of Patent: May 4, 2004

(54) BASE OF AN ELECTRIC DISCHARGE LAMP WITH AN IGNITION DEVICE

(75) Inventors: Karl Gerhard, Hauzenberg (DE); Erwin Gaisbauer, Salzweg (DE); Anton Duschl, Hauzenberg (DE); Johann Winkler, Hutthurn (DE); Christian Wittig, Munich (DE); Guenther Hirschmann, Munich (DE); Peter Helbig, Sontheim/Brenz (DE); Hartmut Froescher, Settingen (DE); Markus Siegner, Senden/Iller (DE); Franz Sagberger, Neukirchen vorm Wald (DE); Guenter Schinkinger, Erlau (DE)

(73) Assignees: Vogt electronic AG, Obernzell (DE); Patent-Treuhand-Gesellschaft fuer elektrische Gluehlampen, Munich (DE)

( * ) Notice: Subject to any disclaimer, the term of this patent is extended or adjusted under 35 U.S.C. 154(b) by 0 days.

(21) Appl. No.: 09/701,004

(22) PCT Filed: Mar. 23, 2000

(86) PCT No.: PCT/EP00/02608

§ 371 (c)(1),
(2), (4) Date: Feb. 5, 2001

(87) PCT Pub. No.: WO00/59269

PCT Pub. Date: Oct. 5, 2000

(30) Foreign Application Priority Data

Mar. 26, 1999 (DE) ..... 199 13 942

(51) Int. Cl.[7] ..... H05B 37/00
(52) U.S. Cl. ..... 315/289; 315/58; 362/221
(58) Field of Search ..... 315/76, 82, 60, 315/209 R, 246, 276, 58; 362/221, 265, 260; 313/318.09, 318.08

(56) References Cited

U.S. PATENT DOCUMENTS

| | | | | |
|---|---|---|---|---|
| 4,677,348 A | | 6/1987 | Schweickardt | 315/307 |
| 4,902,943 A | * | 2/1990 | Nicholson et al. | 315/289 |
| 5,159,242 A | * | 10/1992 | Ravi | 315/52 |
| 5,185,560 A | | 2/1993 | Nilssen | 315/219 |
| 5,228,770 A | | 7/1993 | Brunson | 362/194 |
| 5,485,057 A | * | 1/1996 | Smallwood et al. | 315/58 |
| 5,510,967 A | | 4/1996 | Coushaine et al. | 362/261 |
| 5,659,221 A | | 8/1997 | Coushaine et al. | 313/493 |
| 5,838,109 A | | 11/1998 | Kobayashi et al. | 315/58 |
| 6,194,834 B1 | * | 2/2001 | Seiler et al. | 315/82 |

FOREIGN PATENT DOCUMENTS

| | | |
|---|---|---|
| DE | 19541438 | 5/1996 |
| DE | 19610385 | 9/1997 |
| DE | 19610388 | 9/1997 |
| DE | 19913942 | 4/2000 |
| EP | 0786791 | 7/1997 |
| EP | 0852455 | 7/1998 |
| EP | 0902605 | 3/1999 |
| EP | 0 902 605 A1 | 3/1999 |
| EP | 0975007 | 1/2000 |
| HU | 204 355 B | 12/1991 |

* cited by examiner

*Primary Examiner*—Don Wong
*Assistant Examiner*—Jimmy T. Vu
(74) *Attorney, Agent, or Firm*—Birch, Stewart, Kolasch & Birch, LLP

(57) ABSTRACT

A gas discharge lamp base (1) with a starting device has a carrier part (16) for electronic components (23 through 30) of the starting device. The carrier part (16) has a top side and a bottom side. Only high voltage-carrying components (23 through 26) of the starting device are arranged on the one side of the carrier part (16), and only low voltage-carrying components (27 through 30) of the starting device are arranged on the other side (low voltage side) of the carrier part (16).

27 Claims, 16 Drawing Sheets

BASE OF AN ELECTRIC DISCHARGE LAMP WITH AN IGNITION DEVICE

This application is the national phase under 35 U.S.C. §371 of PCT International Application No. PCT/EP00/02608 which has an International filing date of Mar. 23, 2000, which designated the United States of America.

BACKGROUND OF THE INVENTION

1. Field of the Invention

The present invention relates to a gas discharge lamp base with a starting device.

2. Description of the Background Art

A gas discharge lamp base with a starting device is known from U.S. Pat. No. 5,510,967 A. In the case of the gas discharge lamp base known from U.S. Pat. No. 5,510,967 A, a tubular jacket section of the gas discharge lamp is pressed into the gas discharge lamp base by a slotted ball. Two contact bars arranged inside the gas discharge lamp base guarantee electric contact of the electric current lead-in wire and the current return wire with the respective terminals of the starting device. According to U.S. Pat. No. 5,510,967 A, the starting device has a compact design in the form of an elongated cylinder which extends inside the gas discharge lamp base perpendicular to the longitudinal extent of the gas discharge lamp. However, precise details regarding the internal structure of the starting device cannot be obtained from U.S. Pat. No. 5,510,967 A.

A similar gas discharge lamp base is known from U.S. Pat. No. 5,659,221 A, but instead of the slotted ball, a slotted truncated conical wedge is used to establish the press connection.

German Patent Application 196 10 385 A also describes a gas discharge lamp base with a starting device. According to German Patent Application 196 10 385 A, two electric terminals of the starting device, a first winding of a trigger pulse transformer and two main electrodes of the gas discharge lamp are connected in series. In addition, the two electric terminals of the starting device are connected to one another by a series connection of a capacitor across an ohmic resistor. A series connection of a second winding of the starting impulse transformer with a spark gap is connected in parallel with the capacitor. The starting impulse transformer, including the additional electronic components, the electric terminals, part of the gas discharge vessel, and part of the outer line running along the gas discharge vessel are completely or partially sheathed or cast with a plastic material to form the gas discharge lamp base.

German Patent Application 195 41 438 A describes a gas discharge lamp with a starting device where the high voltage-carrying components of the starting device are arranged in the lamp base, whereas the low voltage-carrying components are arranged in the lamp socket.

U.S. Pat. No. 5,838,109 A discloses a starting device for a discharge lamp with a starter circuit and a noise filter circuit. This starting device, however, is not arranged in a lamp base.

German Patent Application 196 10 388 A discloses another gas discharge lamp base with a starting device. The starting device according to German Patent Application 196 10 388 A has a high voltage capacitor and a Tesla transformer. The two latter components are arranged in such a way that the high voltage capacitor is surrounded by the secondary coil of the Tesla transformer.

SUMMARY OF THE INVENTION

It is therefore an object of the present invention to provide a gas discharge lamp base with a starting device having improved operational reliability in comparison with the known gas discharge lamp bases.

This object is achieved by a gas discharge lamp base with a starting device having a carrier part for electronic components of the starting device, wherein the carrier part has a first side and a second side, with only high voltage-carrying components of the starting device being arranged on the first side of the carrier part and only low voltage-carrying components of the starting device being arranged on the second side of the carrier part, and wherein at least one starting transformer being arranged on the carrier part as the high voltage-carrying component, at least the following components being arranged on the carrier part as the low voltage-carrying components: a spark gap and a starting capacitor, at least the following components are also arranged on the carrier part as the high voltage-carrying components: an interference suppression coil and a high voltage capacitor, and in addition, at least the following components are also arranged on the carrier part as the low voltage-carrying components: an interference suppression capacitor and an ohmic resistor.

The improved operational reliability of the present invention is achieved through complete spatial separation of the high voltage-carrying components from the low voltage-carrying components, with all these components nevertheless being accommodated in the gas discharge lamp base so that the gas discharge lamp base does not have to be connected to a power supply over a high voltage interface, but instead can be connected over a low voltage interface. With regard to the definition of terms, it should be pointed out that "low voltage" is understood herein to refer to a voltage of up to a few kV (kilo Volts). In contrast with that, the term "high voltage" here refers to a voltage above approximately 10 kV, in particular a voltage of a few tens of kV.

The special three-dimensional arrangement of the interference suppression coil(s), being arranged with respect to the direction of gas discharge, contributes to an especially good electromagnetic compatibility of the gas discharge lamp base with a starting device.

Furthermore, especially good high voltage isolation and thus an especially good operational reliability is realized.

A labyrinth in conjunction with the top part of the housing and the carrier part forms a longer path for any creep current that may occur and is therefore an especially effective insulation measure which contributes toward an improvement in operational reliability in an advantageous manner. Similar advantages are realized with respect to the bottom part of the housing.

A high voltage strength of the gas discharge lamp base is improved due to the closed outer contour of the gas discharge lamp base, and the thermal load-bearing capacity of the electric components arranged in the gas discharge lamp base is reduced due to the radiant heat emitted by the gas discharge, and failure of the components contained in the gas discharge lamp base is prevented.

The planar conductor frame (also called a lead frame) offers the advantage that the terminals can be welded in one plane at the time of manufacture. The lead frame also offers other advantages: thicker circuit board conductors than in the case of printed circuits, a greater strength of the carrier due to the plastic-sheathed circuit board conductors, and the creep paths can be lengthened by integrally molded ribs.

After assembly of the components on the high voltage side of the carrier part, its walls are treated with a so-called primer which ensures a good bond between the inside wall of the high voltage space and the subsequently introduced casting compound. This primer is poured into the high voltage compartment and is poured out again immediately. Nevertheless, primer can still penetrate into the bushings for the terminal wires. To prevent this, the partition between the high voltage side and the low voltage side of the carrier part should be absolutely tight. This, however, cannot be achieved in the conventional art, because of terminal wires passing through boreholes.

The present invention also remedies this situation because the connection between the bottom of the carrier part and the metal tube and the contacting of the ends of the tubes on the circuit board conductors can be designed to be tight in a reliable manner.

Thus, the insertion of the terminal wires of the components of the high voltage side into the metal tubes is facilitated.

This facilitates the insertion of the tubes, which are fixedly connected to the bottom of the carrier part, into the holes provided in the circuit board conductors of the lead frame. In addition, by means of a protrusion of the edges of the holes in welding, a reserve of material is made available.

The joint welding of the ends of the tubes to the respective terminal wire and the circuit board conductor permits an absolutely tight seal.

In addition, the metal tubes also have the function of securing the lead frame after welding, optionally supported by lugs provided on the top part of the carrier.

Finally, the metal housing surrounding the lamp base has the advantage of good shielding with respect to the outside. It is irrelevant here how the interference suppression coils are arranged with respect to the gas discharge burning in the gas discharge vessel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
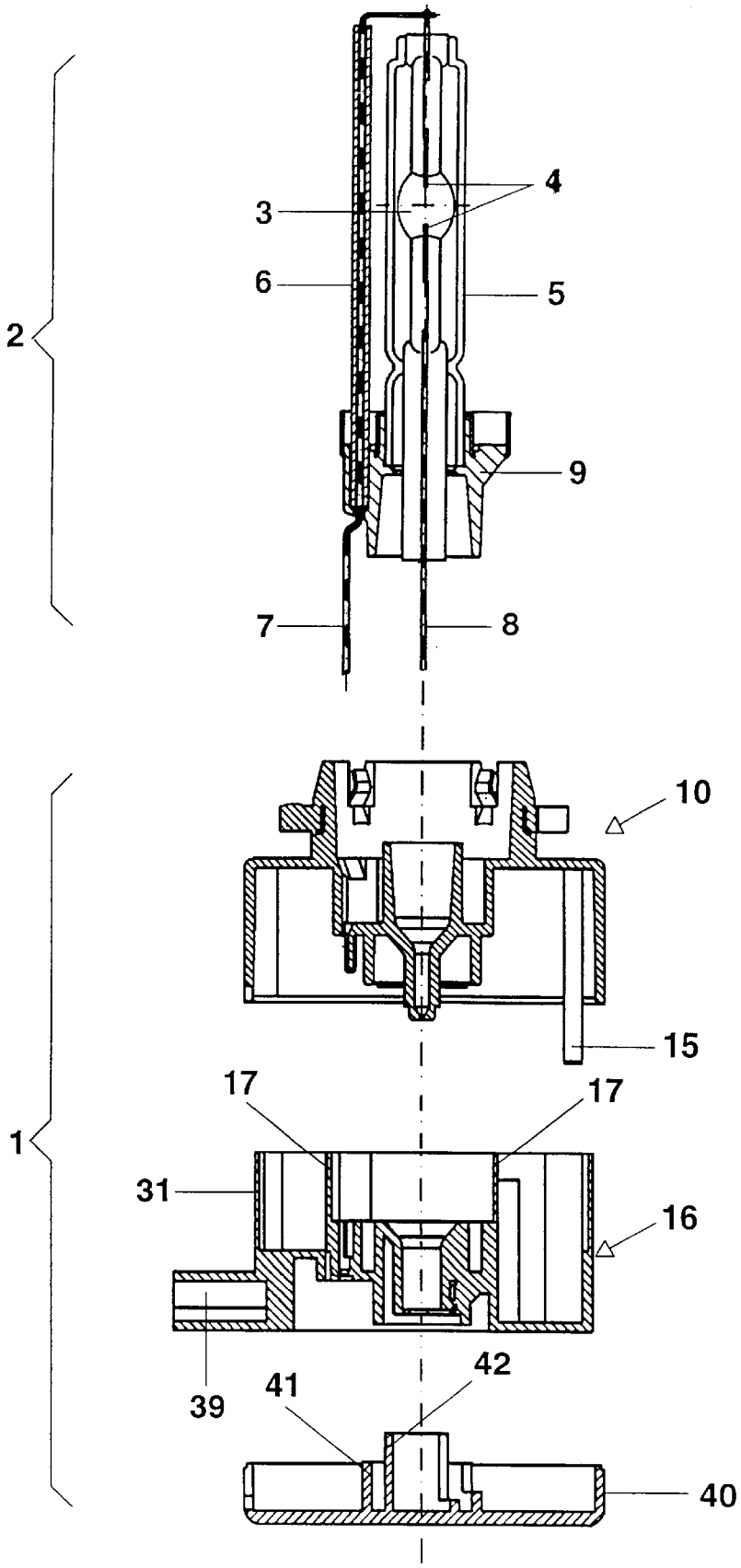
FIG. 1 is a schematic of a gas discharge lamp base in a cross-sectional view from the side, partially dismantled, without electronic components.
Figure 2:
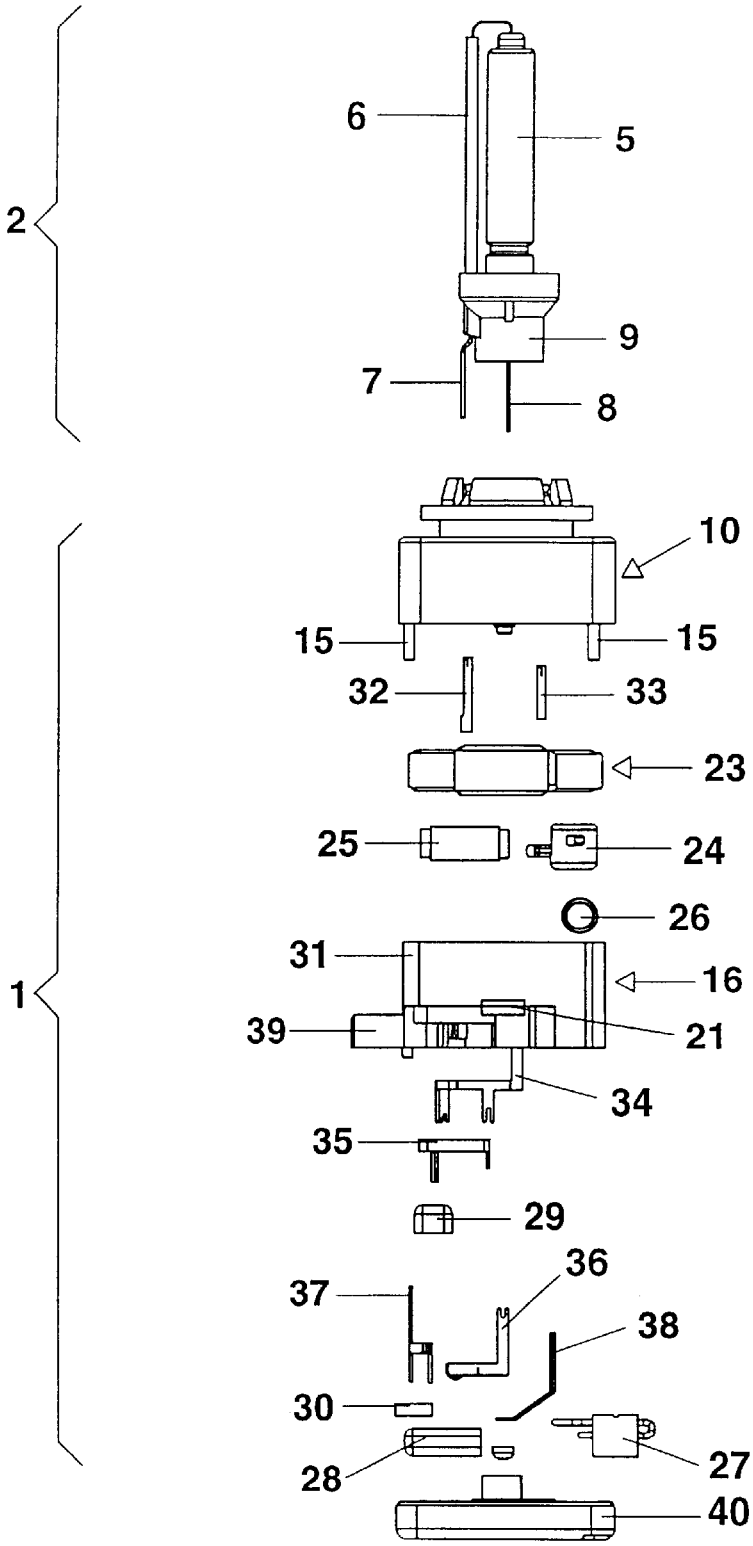
FIG. 2 is a schematic of the gas discharge lamp base with the electronic components installed and the respective gas discharge lamp in an exploded diagram shown from the side.
Figure 3:
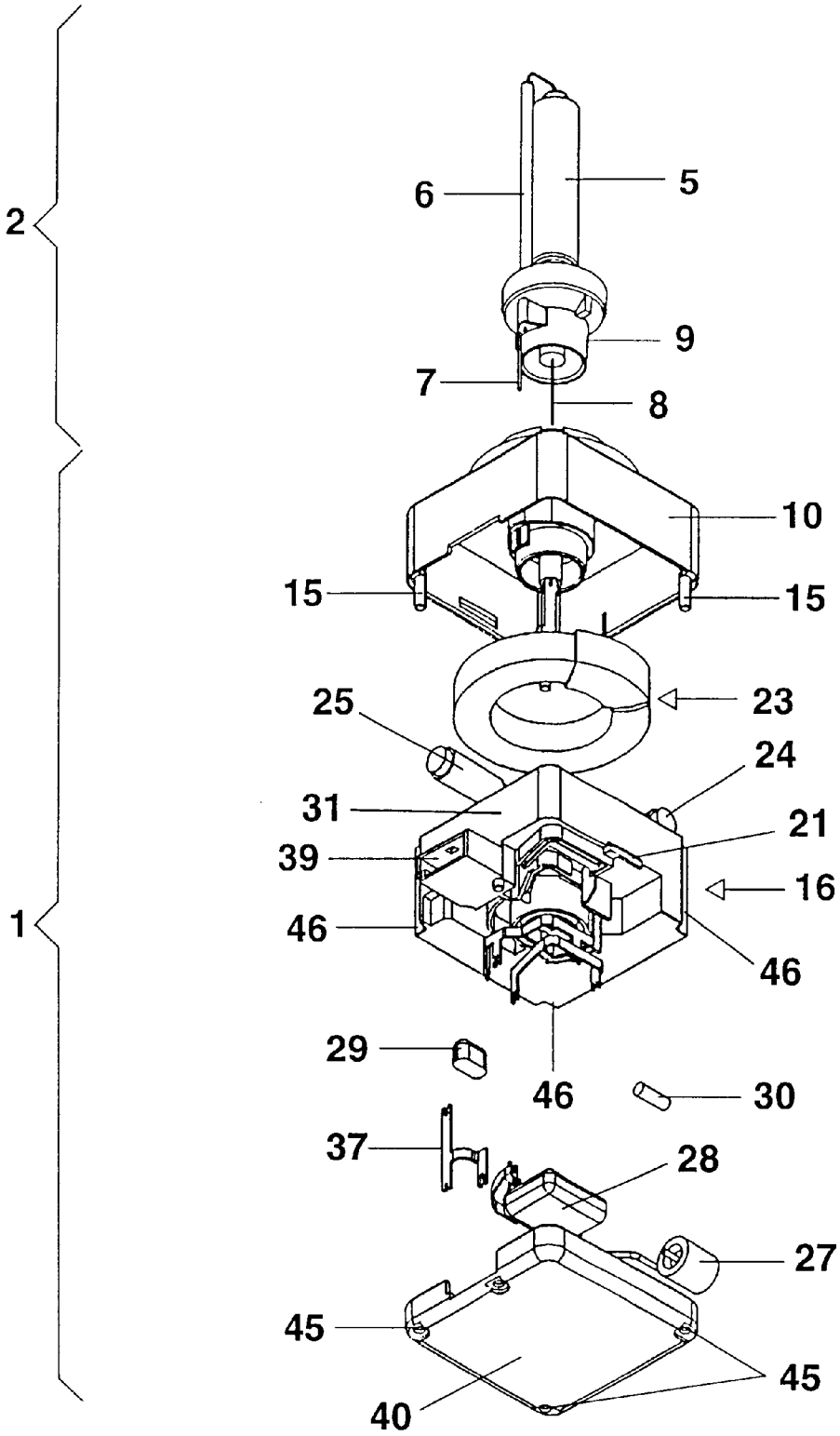
FIG. 3 is a perspective exploded diagram of the gas discharge lamp base shown in FIG. 2.
Figure 4:
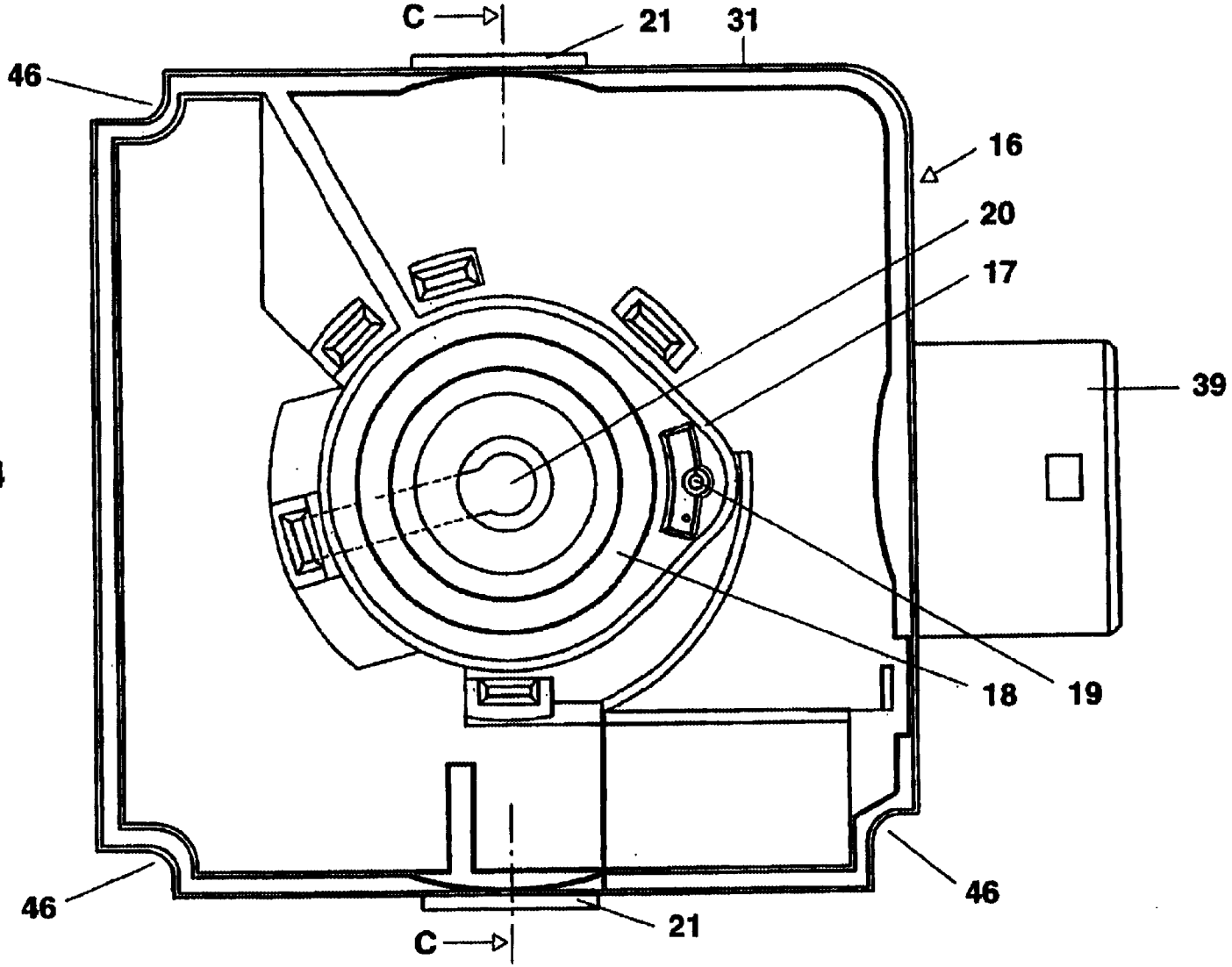
FIG. 4 is a plan view, shown from above, of a carrier part for electronic components.of a starting device in the gas discharge lamp base.
Figure 5:
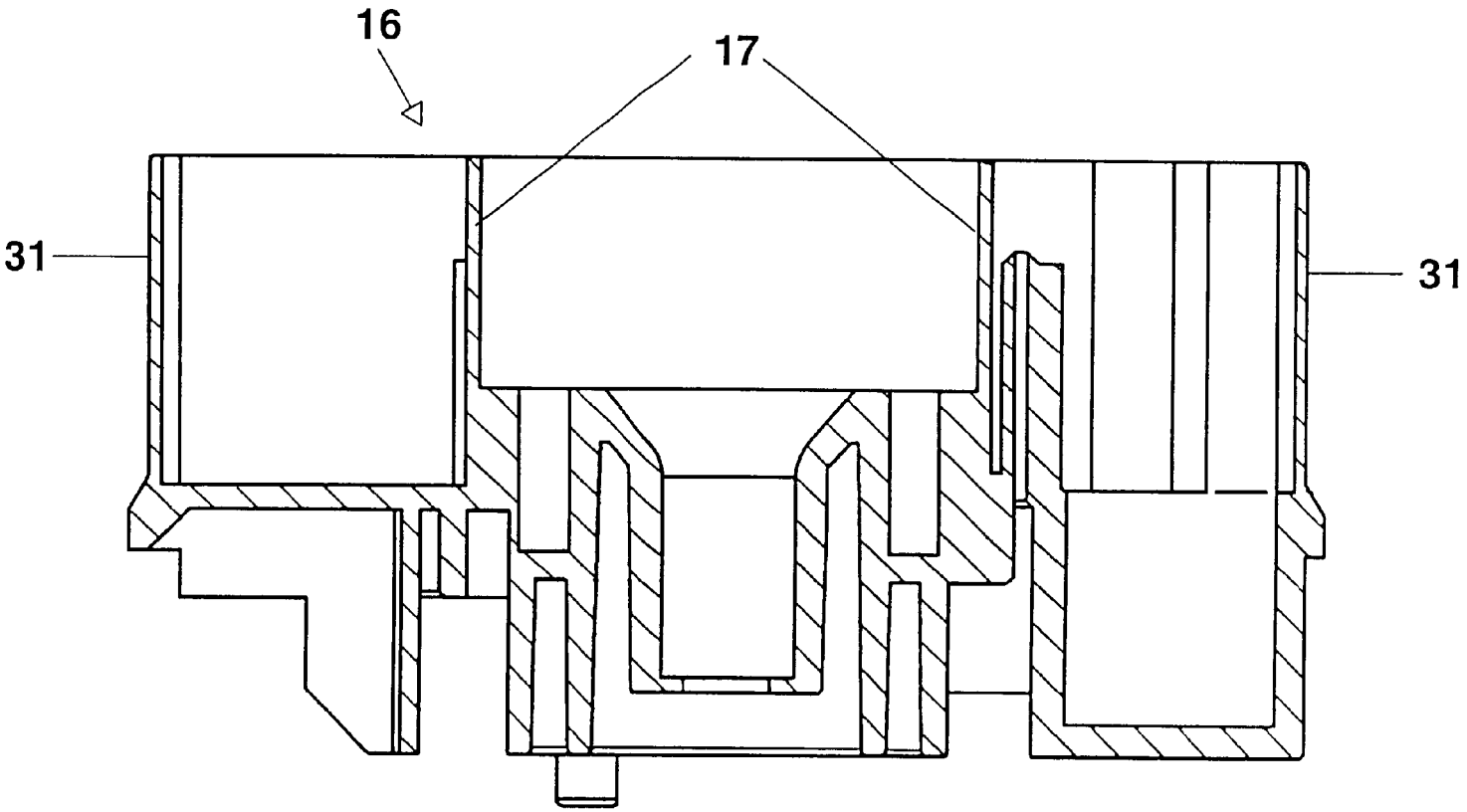
FIG. 5 shows section C—C from FIG. 4.
Figure 6:
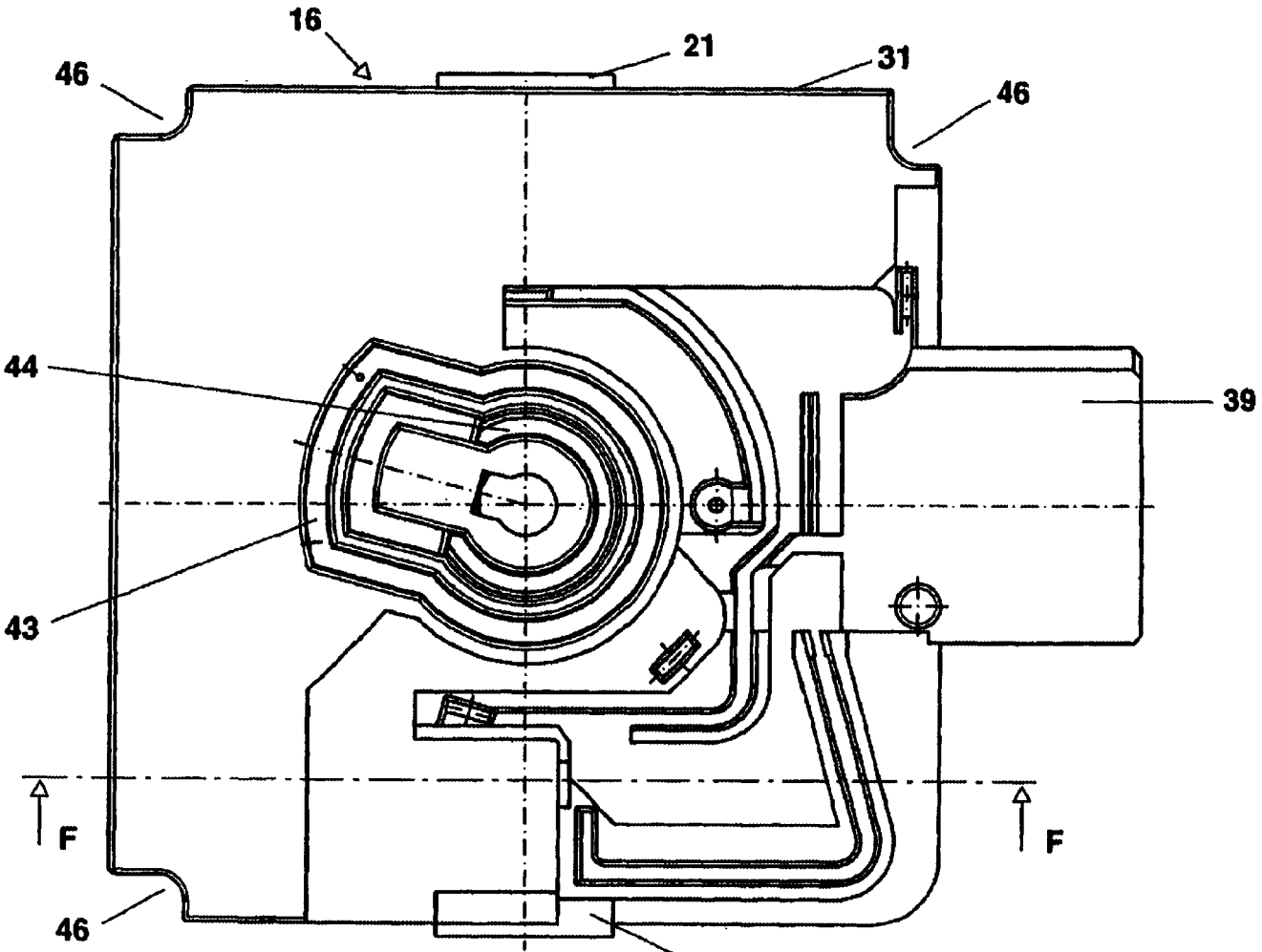
FIG. 6 is a plan view, from beneath, of the carrier part illustrated in FIG. 4.
Figure 7:
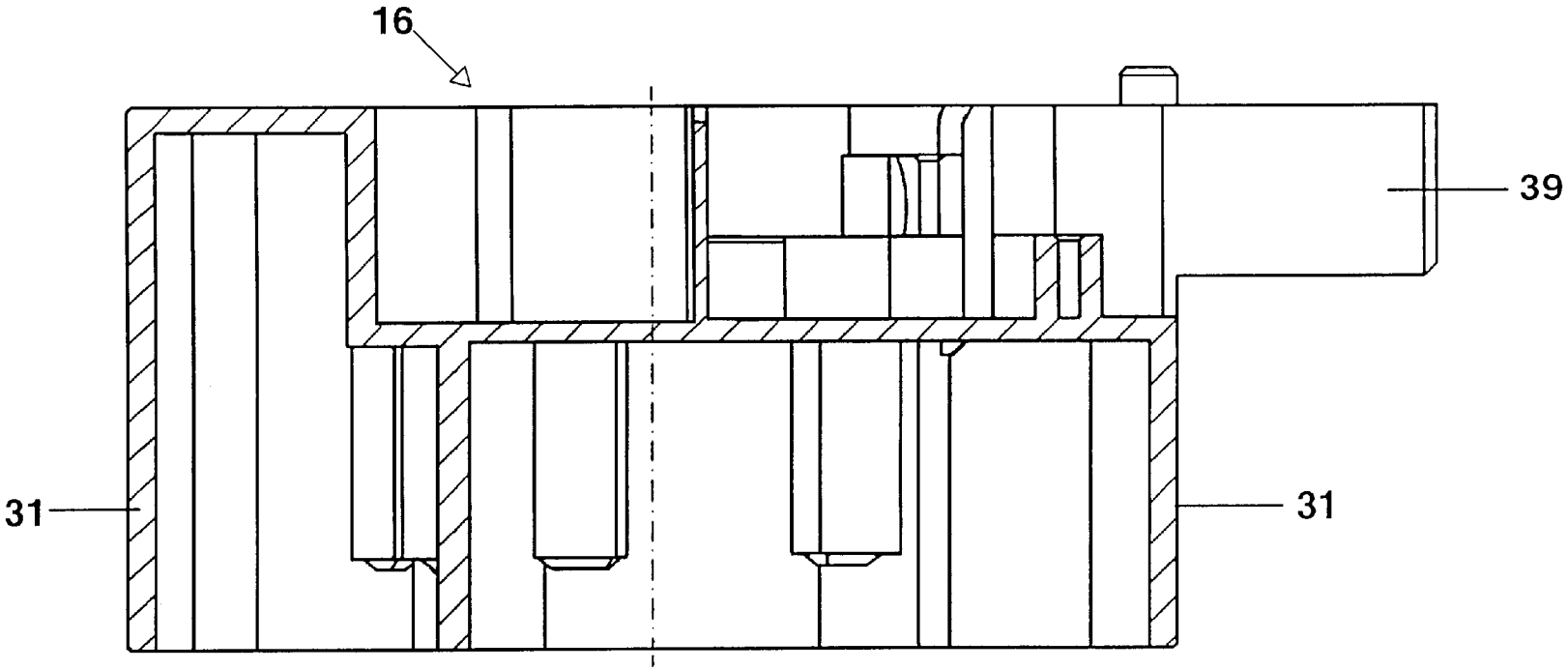
FIG. 7 shows section F—F from FIG. 6.

FIGS. 1 through 3 illustrate an embodiment of a gas discharge lamp base 1 according to this invention with a starting device, the components, however, belonging to the starting device are not illustrated in FIG. 1. FIG. 1 shows a gas discharge lamp 2, whose gas discharge vessel 3 with gas discharge electrodes 4, outer plunger 5, current return wire 7, partially sheathed with a ceramic tube 6, and inner current lead-in wire 8, and an inside base part 9 form one structural unit which is mounted in a housing top part 10 of the gas discharge lamp base and is adjusted there.

Figure 8:
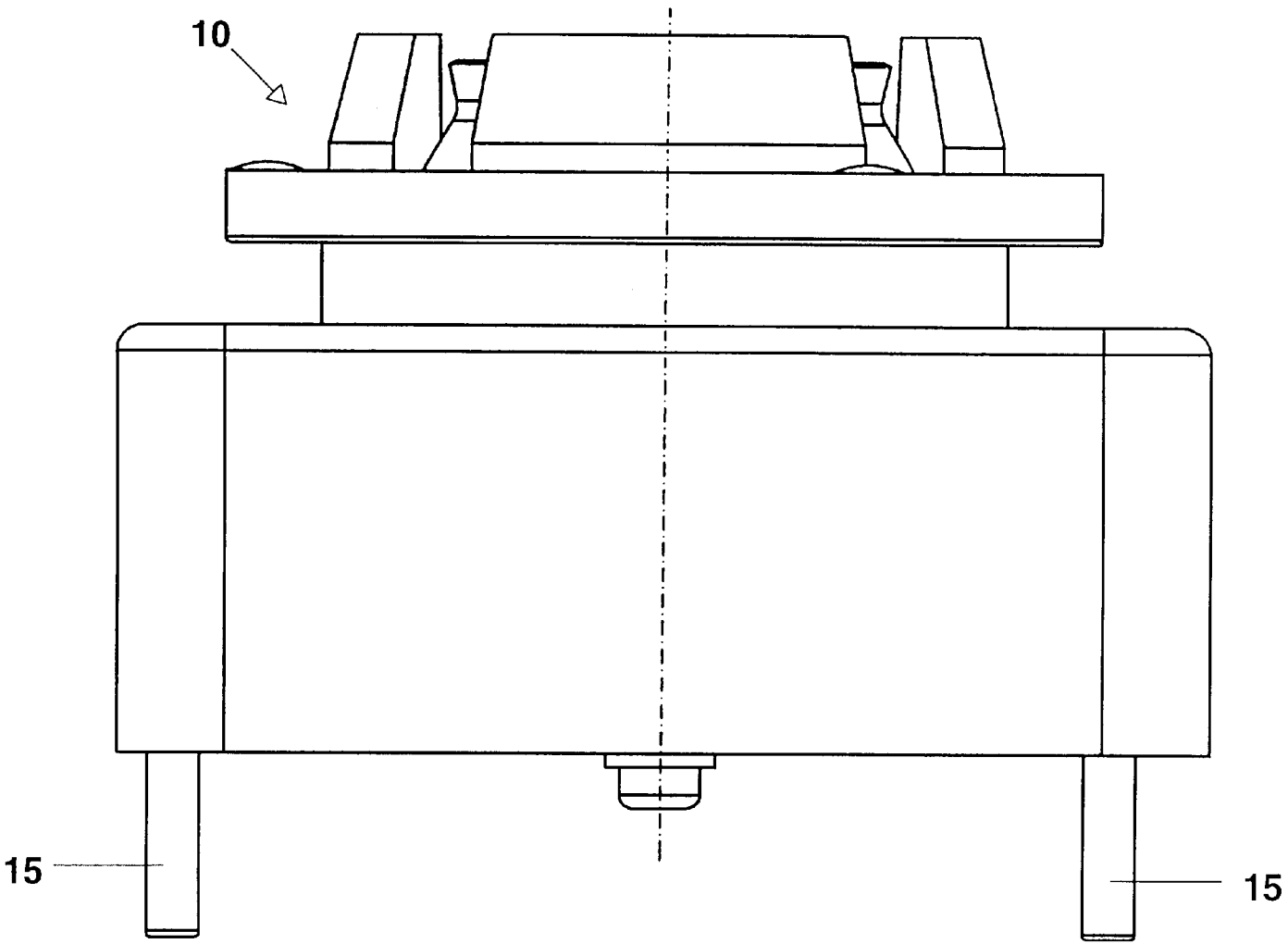
FIG. 8 is a side view of a housing top part of the gas discharge lamp base.
Figure 9:
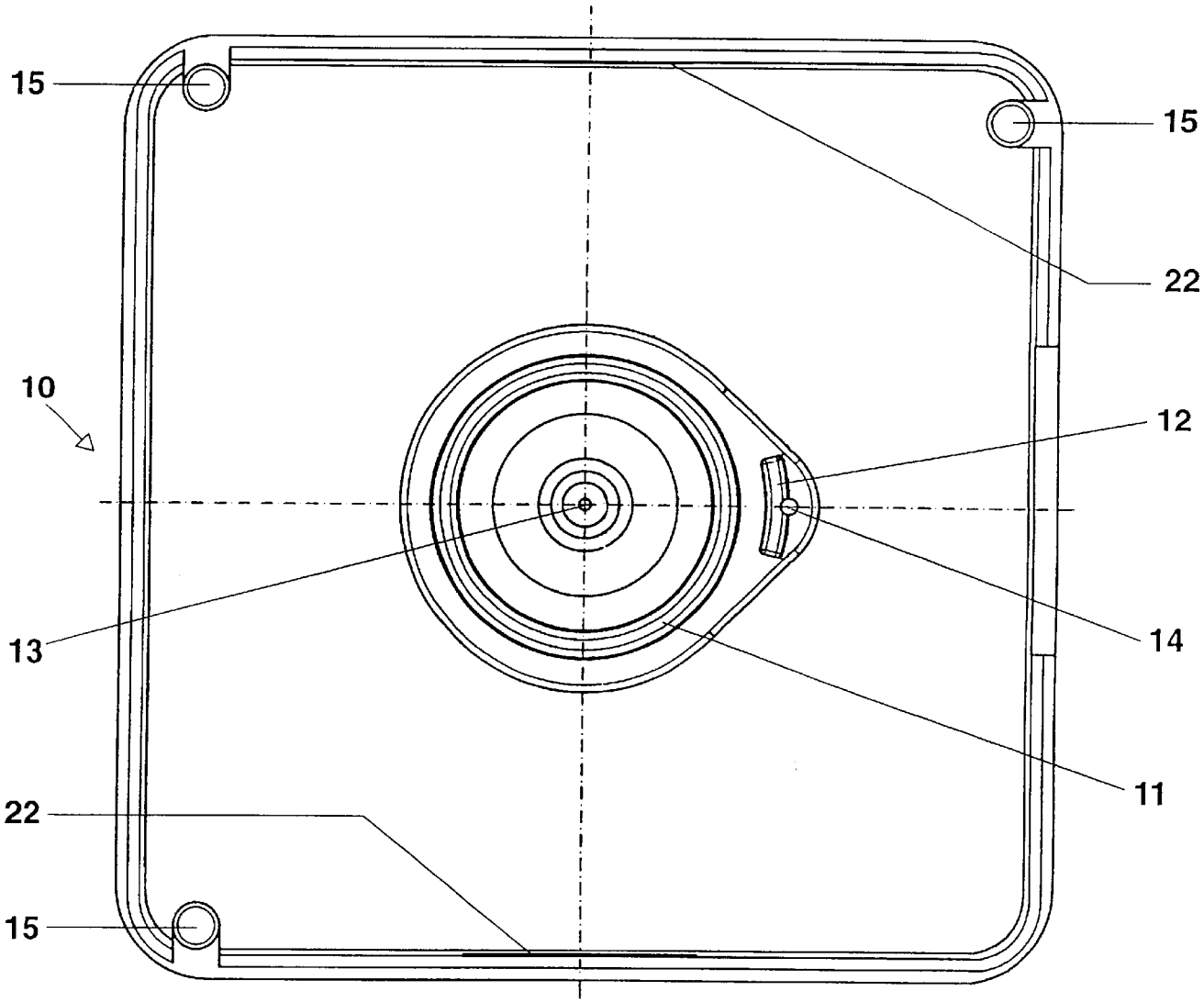
FIG. 9 is a plan view, from beneath, of the top part of the housing illustrated in FIG. 8.
Figure 10:
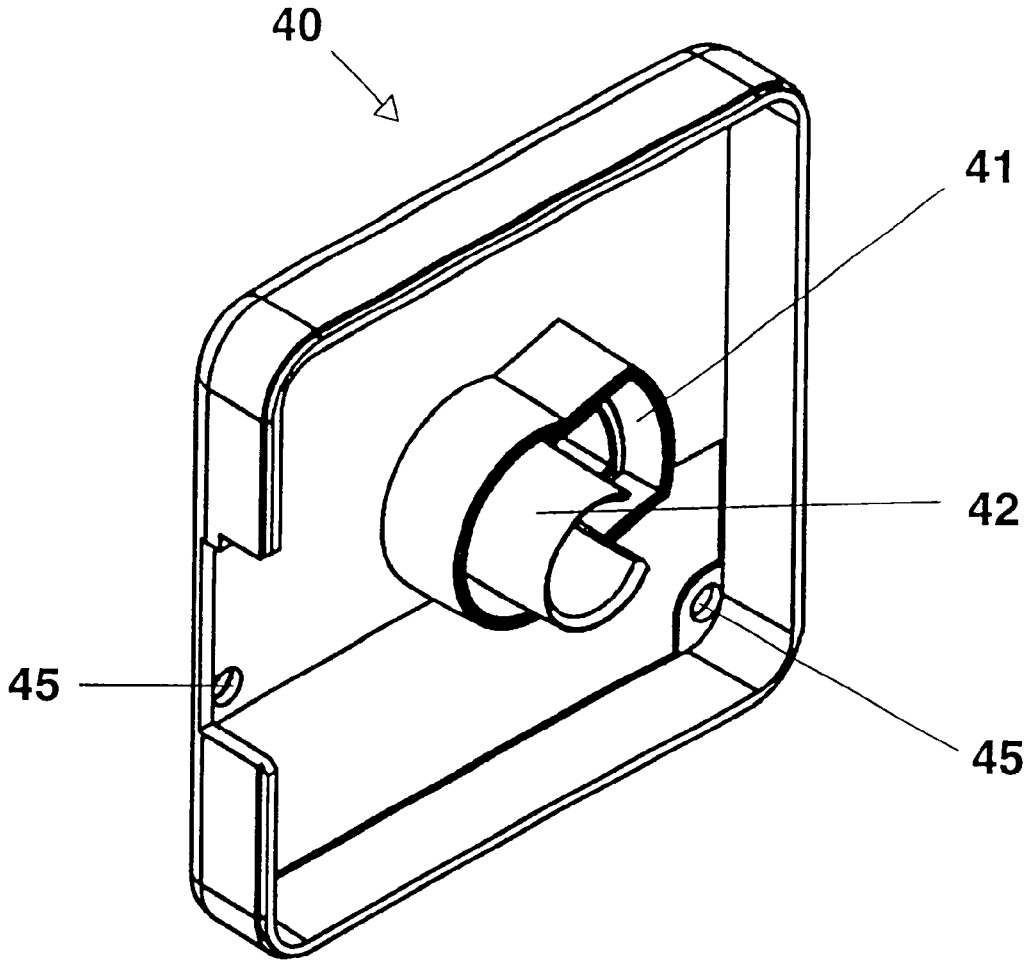
FIG. 10 is a perspective view of a bottom part of a housing of the gas discharge lamp.

Housing top part 10 (see also FIGS. 8 and 9) has electrically insulated bushings or openings 13, 14 for the inner current lead-in wire 8 and the current return wire 7. Additional isolating webs 11, 12 on the housing top part 10 improve the electric insulation between the current return wire 7 and the inner current lead-in wire 8.

Gas discharge lamp base 1 according to this invention also has a carrier part 16 for electronic components of the starting device (see also FIGS. 4 through 7). The carrier part 16 is provided with form-fitting receptacles 17 through 20 for the bushings 13, 14 and the isolating webs 11, 12 of the housing top part 10. This forms a labyrinth for any creep currents that might occur. The entire starting device (electronic starter) for the gas discharge lamp 2 is mounted in the carrier part 16. The carrier part 16 together with the electronic components of the starting device is inserted into the housing top part 10, where it is locked in place by means of catches 21 which engage in corresponding recesses 22 on the inside walls of housing top part 10.

Carrier part 16 has a top side and a bottom side and is fitted on both sides with the components of the starting device. The terms "top side" and "bottom side" are not necessarily to be interpreted as smooth sides. As illustrated in FIGS. 1 through 7, each side may have its own steps. However, the top side and the bottom side are separated from one another so that it is impossible to go from one of these two sides to the other without having to pass over an outer edge 31 of the carrier part 16 or through one of the two bushing holes 19, 20 located inside the inner receptacle wall 17.

Carrier part 16 is assembled in such a way that the components of the starting device carrying a high voltage (approx. 30 kV) are arranged on one side of the carrier part 16, and the components of the starting device carrying a low voltage (approx. 2 kV) are arranged on the other side of carrier part 16.

In particular, an ignition transformer, which is designed as a toroidal core transformer 23 (FIGS. 2, 3), two interference suppression coils 24, 25 and one high voltage capacitor 26 are located on the high voltage side of carrier part 16. These high voltage-carrying components 22 through 26 are embedded in an electrically insulating casting compound. The two interference suppression coils 24, 25 are located across the direction of the gas discharge burning in the respective gas discharge vessel 3 to achieve the best possible electromagnetic compatibility of the entire arrangement. In the present embodiment, the two interference suppression coils 24, 25 are also mounted in particular across the longitudinal extent of gas discharge lamp 2.

On the side facing away from the high voltage side of the carrier part 16, namely the low voltage side of the carrier part 16, are arranged a spark gap 27, a starting capacitor 28, an interference suppression capacitor 29 and an ohmic resistor 30. Heat-sensitive parts are arranged at the greatest possible distance from the gas discharge vessel 3.

Walls 31, 17 of the carrier part 16 form cast compartments and also serve as electric insulation. Additionally, the carrier part 16 has additional compartments for metallic insert parts 32 to 38 that can be formed by various processes such as punching or bending. The metallic insert parts 32 to 38 establish electric contact with the inner current lead-in wire 8 and the current return wire 7 and are provided with U-shaped brackets for contacting wires, in particular for connecting wires of electronic components 27 through 30. The wires are welded to the metallic insert parts 32 to 38, i.e., no circuit board is used but instead the electronic design is based on the lead-frame technology.

Carrier part 16 is also provided with a collar space 39 which serves to accommodate a plug of a connecting cable. The connecting cable connects the starting device to the remaining components, which are accommodated in a separate operating device, of the circuit arrangement which is necessary for operation of the lamp.

The embodiment of gas discharge lamp base 1 according to this invention with the starting device illustrated here is also provided with a housing bottom part 40 (see FIGS. 1 through 3 and 10). Housing bottom part 40 has electrically insulating webs and walls 41, 42 which engage in a form-fitting manner in corresponding receptacles 43, 44 of the carrier part 16 (see FIG. 6). This forms a labyrinth of insulation walls, creating elongated pathways for any creep currents that might occur and thus contributing toward a guarantee of especially good operational reliability of gas discharge lamp base 1 according to this invention with the starting.

Housing top part 10 is provided with integrally molded pins or lugs 15 which extend in guide grooves 46 of the carrier part 16 and pass through corresponding openings 45 in the housing bottom part 40, where they are ultrasonically welded to the housing bottom part 40. In other embodiments of the gas discharge lamp base 1, the housing top part 10 and housing bottom part 40 are laser welded together at the periphery or are locked together peripherally or in segments.

Housing top part 10, the carrier part 16 and the housing bottom part 40 are each made of an electrically insulating plastic which can withstand high thermal loads. The operating temperature in the gas discharge lamp base 1 may amount to up to 150EC with this choice of materials. In the embodiment illustrated here, the gas discharge lamp base has a closed outer contour in the assembled state. The resulting special advantages have already been explained above.

Figure 11:
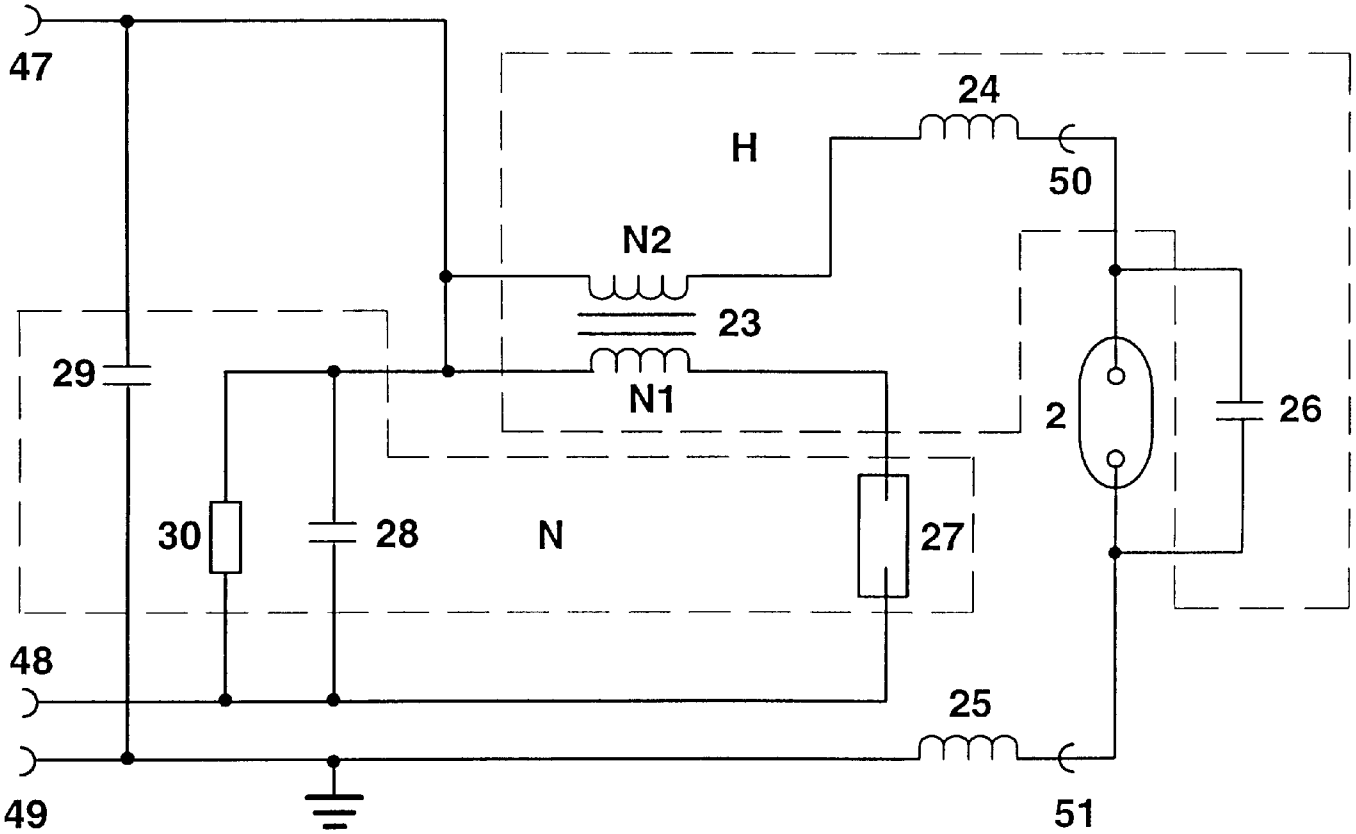
FIG. 11 is a circuit arrangement of the starting device with the gas discharge lamp connected.

The electric circuit design of a starting device will now be explained, with reference to FIG. 11.

In this embodiment, the starting device is a so-called asymmetrical pulse starting device. Of the three d.c. voltage terminals 47, 48, 49, optionally two are used. The d.c. voltage terminal 49 is at ground and leads over a resistor 25 to a terminal 51 of the gas discharge lamp 2. The d.c. voltage terminal 47 is for a power supply voltage of −400 V, and d.c. voltage terminal 48 is for a power supply voltage of +600 V. The starting capacitor 28 is discharged in bursts over a spark gap 27 and over the primary winding N1 of starting transformer 23. The discharge current flowing through the primary winding N1 of starting transformer 23 induces unipolar high voltage pulses of a positive or negative polarity, depending on the power supply voltage used, in the secondary winding N2 of starting transformer 23. The inner current lead-in wire 8 of the gas discharge lamp 2 receives these high unipolar voltage pulses at terminal 50. The starting voltage pulses in the present embodiment have an amplitude of approximately 25 kV and a pulse width of approximately 300 ns. High voltage capacitor 26 is connected in parallel to the discharge path of the gas discharge lamp 2.

Figure 12:
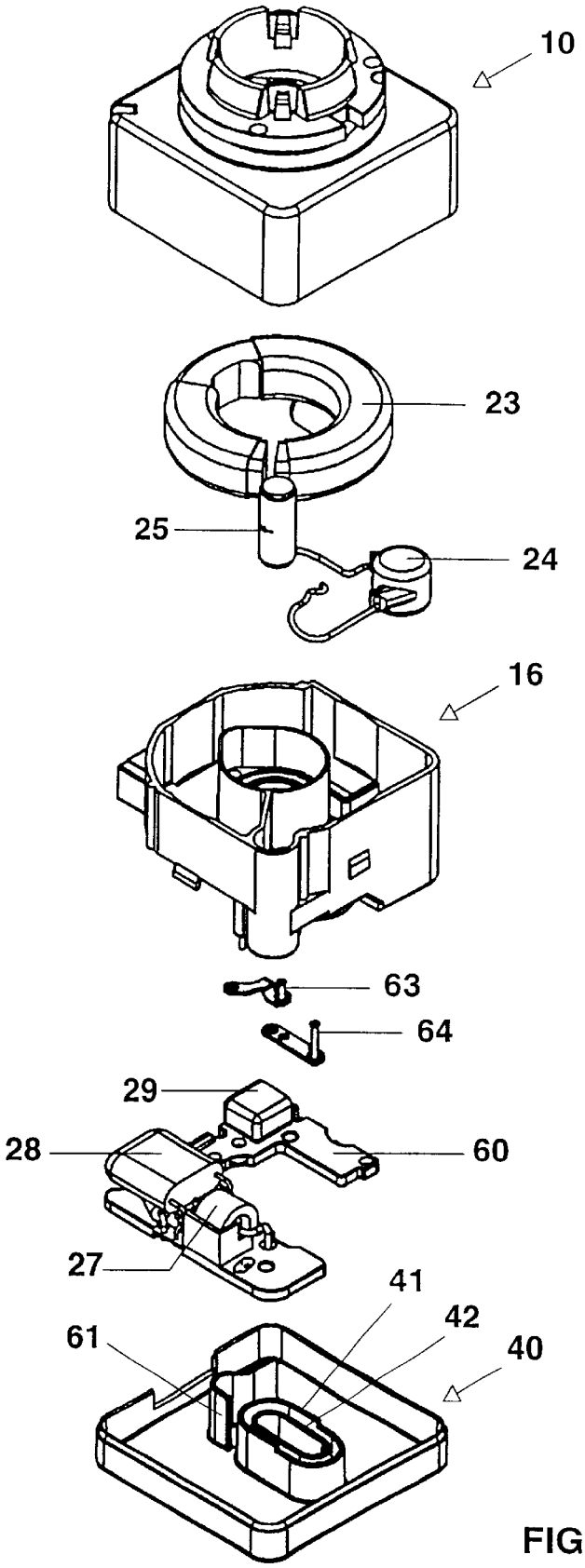
FIG. 12 is a perspective exploded diagram of a gas discharge lamp base.
Figure 13:
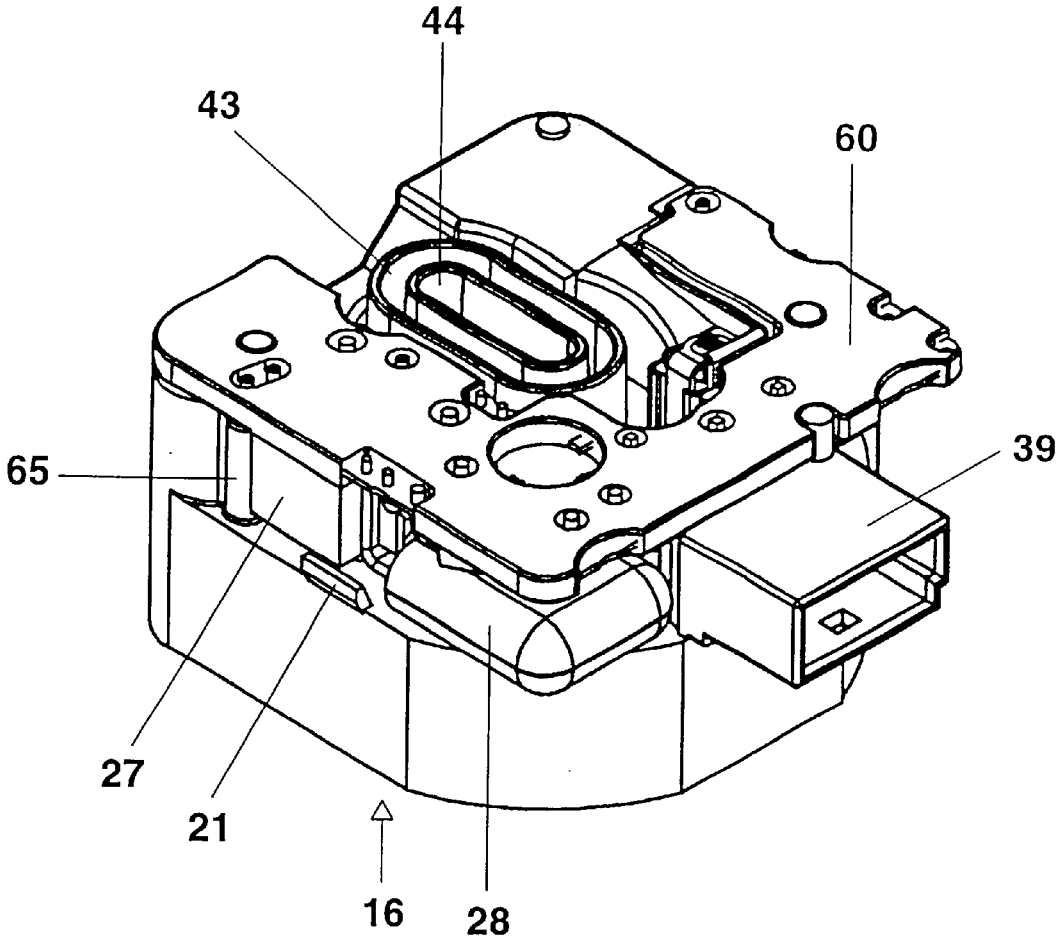
FIG. 13 is a perspective diagram of a carrier part with the lead frame mounted on it.
Figure 14:
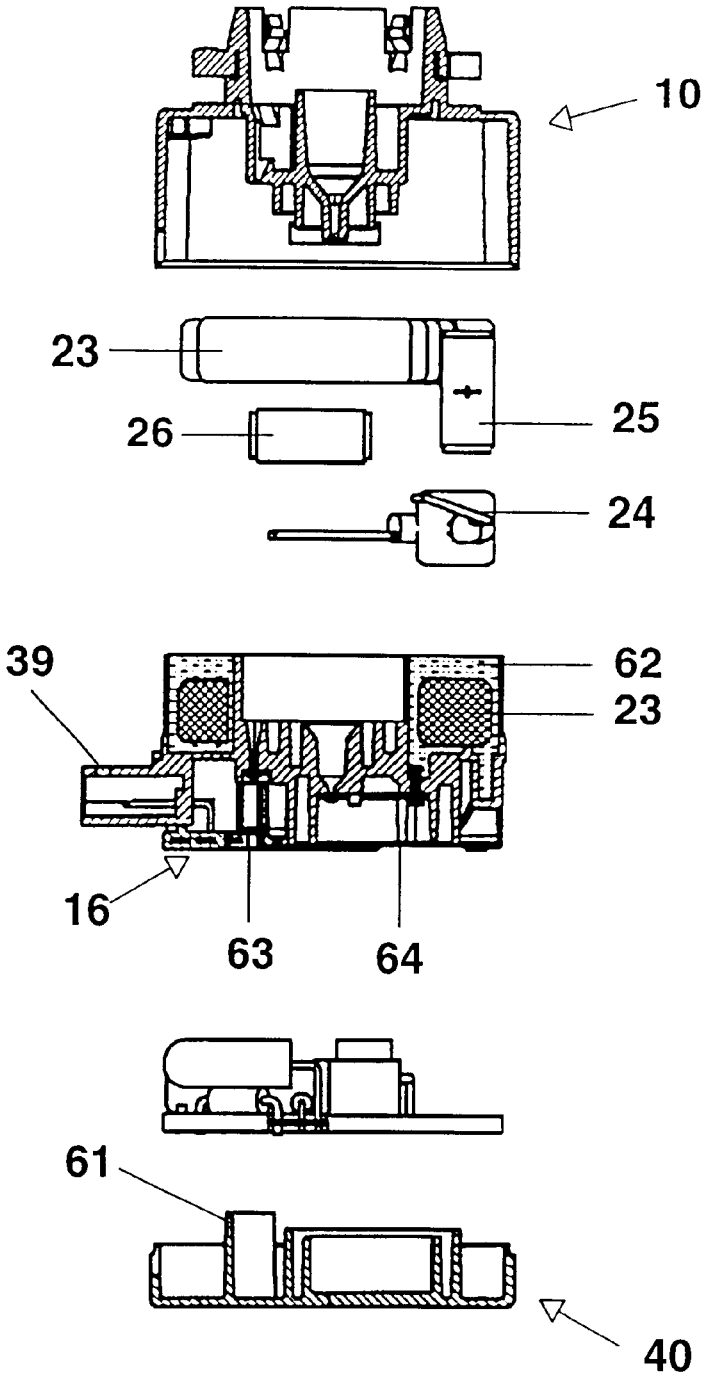
FIG. 14 is an exploded diagram shown the side, of the essential parts of the base illustrated in FIG. 12 in an exploded diagram shown from the side.

The embodiment of the gas discharge lamp base as illustrated in FIGS. 12 through 14, essentially resembles those described above. The base consists of the essential components: a housing top part 10, a carrier part 16 and a bottom part 40. The essential changes in comparison with the first embodiment are to be found in the lead frame 60, which carries the spark gap 27, the capacitors 28, 29, the resistor 30 and a threshold switch 52 (FIG. 17), the additional partition 61 on the housing bottom part 40 and the contact strap 63 and the base contact 64.

FIG. 13 shows the carrier part 16 after assembly of the lead frame 60 with the low voltage-carrying components of the base. As illustrated in this diagram, all the contacts are arranged in a plane, thus greatly facilitating welding of the contacts.

As shown in FIG. 14, the base contact 64 connects the inner current lead-in wire 8 to a terminal of the toroidal core transformer. The contact strap 63 connects the current return wire 7 of the gas discharge lamp to the interference suppression coil 24. The additional labyrinth partition 61 serves to shield the contact strap 63 from the low voltage-carrying components on the lead frame 60. As shown in this figure, the toroidal core transformer (together with the other high voltage-carrying components of the base) is cast in a casting compound 62.

Figure 15:
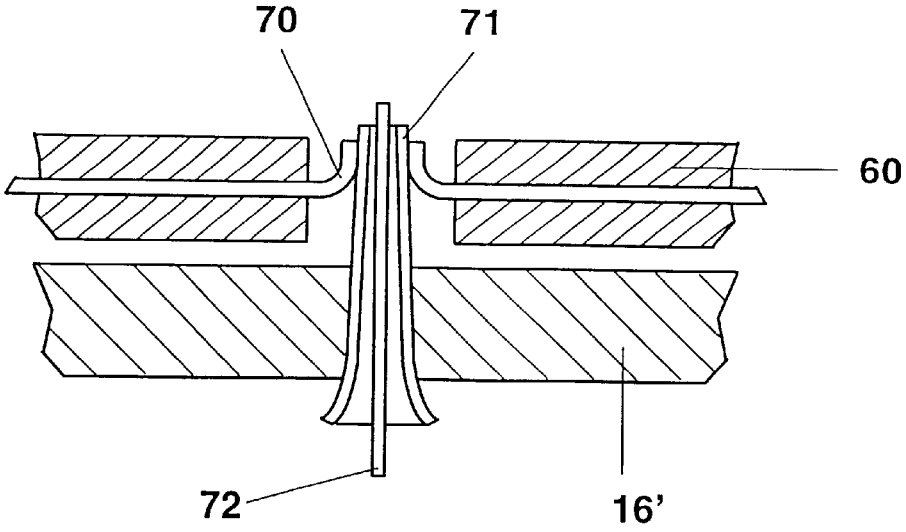
FIG. 15 is a partial sectional view of the bottom of the carrier part and the lead frame.

FIG. 15 shows a partial section of the partition 16' of the carrier part 16. Beneath this wall are the high voltage-carrying components of the base on the lead frame 60, and above this wall are the low voltage-carrying components of the base on the lead frame 60. A tube made of metal such as copper is injected or pulled into the partition 16' and the connection between the two is absolutely tight. The lead frame 60 arranged above the partition 16' consists essentially of the circuit board conductors 70, which are sheathed by insulating plastic. There are holes at the contact points protruding upward, i.e., toward the side facing away from the high voltage-carrying side. The metal tubes 71 are inserted into these funnel-shaped protrusions. The terminal wires 72 are in turn inserted into the metal tubes, which are widened in a funnel shape on the high voltage side. After welding the ends of the terminal wires 72 to the ends of the tubes 71 and the protrusions of the circuit board conductors 70, a tight weld is obtained, guaranteeing a reliable seal between the two sides of the carrier bottom 16.

Figure 16:
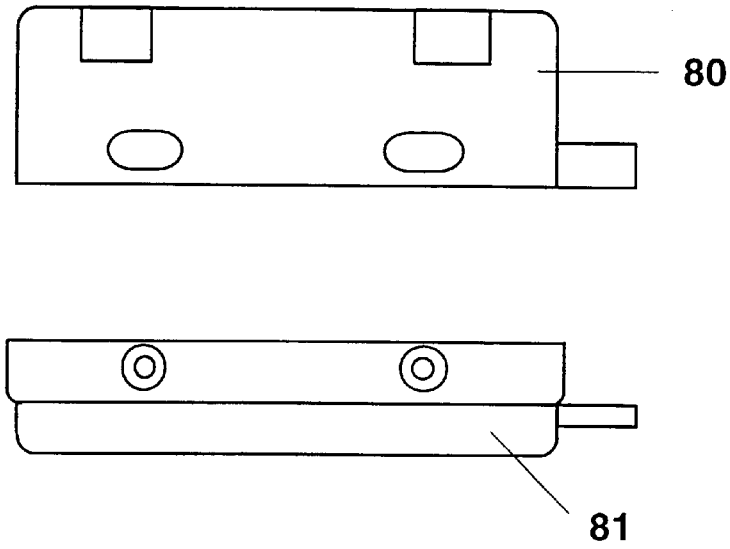
FIG. 16 is an illustration of the top and bottom parts of a metal housing enclosing the base.

FIG. 16 illustrates a metal housing consisting of two halves, the top part 80 and the bottom part 81 and surrounds the base 1 on all sides. This yields a reliable shielding of the base, in which case it does not matter where the interference suppression coils 24, 25 are positioned.

Figure 17:
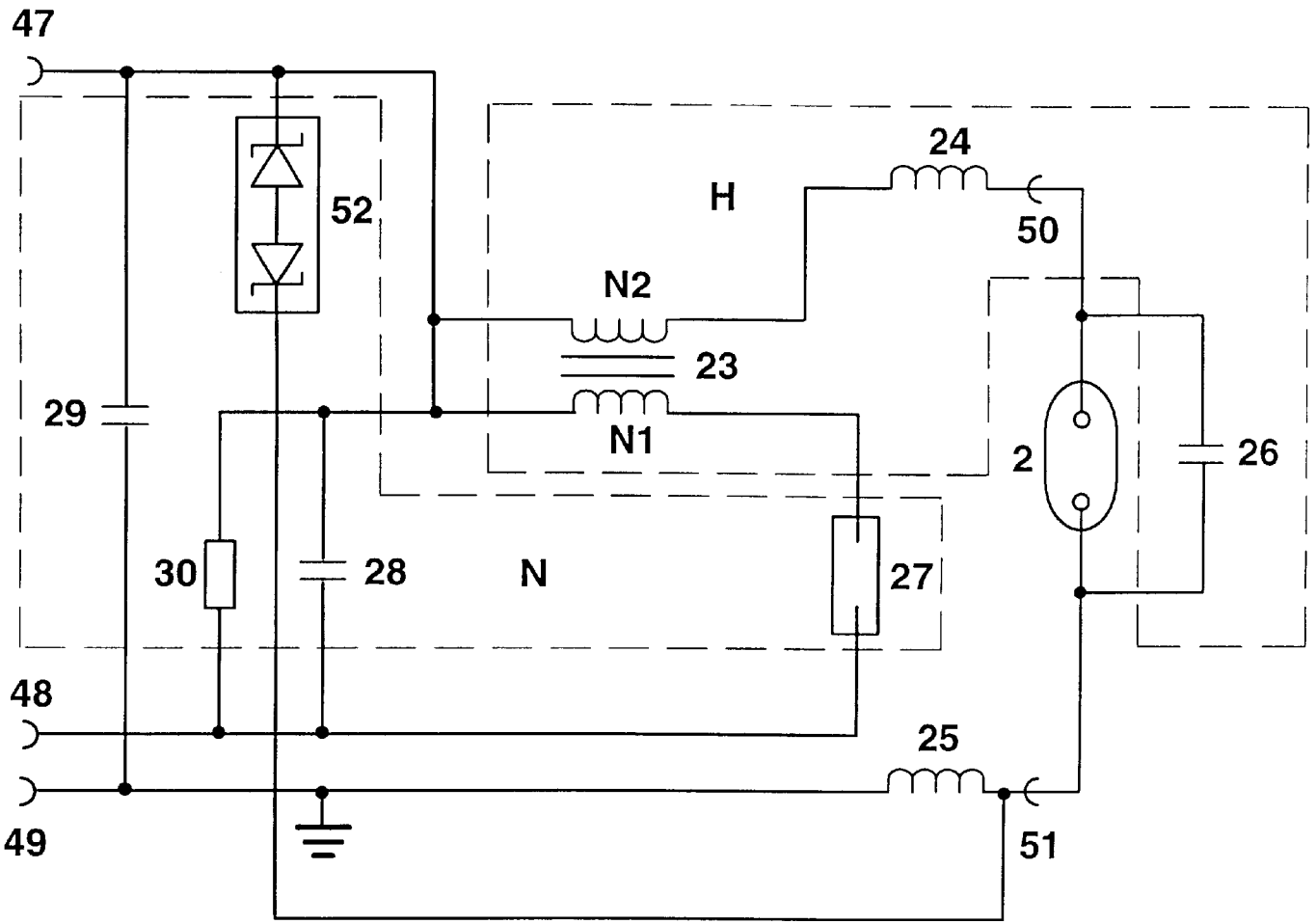
FIG. 17 is a schematic diagram of a circuit arrangement of the starting device with the gas discharge lamp connected.

FIG. 17 illustrates the schematic diagram of a second embodiment of the starting device with the gas discharge lamp 2 connected. This circuit arrangement differs from that illustrated in FIG. 11 by a bidirectional threshold switch 52 which is connected to terminal 47 on the one end and to terminal 51 on the o ther end, i.e., it is connected in parallel to capacitor 29 and resistor 25, so that the schematic diagram of this threshold switch corresponds to two Zener diodes connected in series and in the opposite directions. Such a threshold switch is distributed by the company SGS Thompson under the brand name Transil® diode. As an alternative, the threshold switch 52 may also be connected to ground instead of being connected to terminal 51. The high voltage-carrying components and the low voltage-carrying components are each bordered with a dotted line and are labeled as H [high] and N [low].

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A gas discharge lamp base with a starting device having a carrier part for electronic components of the starting device, wherein the carrier part has a first side and a second side, with only high voltage-carrying components of the starting device being arranged on the first side of the carrier part and only low voltage-carrying components of the starting device being arranged on the second side of the carrier part, and wherein at least one starting transformer being arranged on the carrier part, as the high voltage-carrying component, at least the following components being arranged on the carrier part as the low voltage-carrying components: a spark gap and a starting capacitor, at least the following components are also arranged on the carrier part as the high voltage-carrying components: an interference suppression coil and a high voltage capacitor, and in addition, at least, the following components are also arranged on the carrier part as the low voltage-carrying components: an interference suppression capacitor and an ohmic resistor.

2. The gas discharge lamp base according to claim 1, wherein at least one of the interference suppression coils is arranged across the direction of the gas discharge burning in the gas discharge vessel.

3. The gas discharge lamp base according to claim 1, wherein the starting transformer is a toroidal core transformer.

4. The gas discharge lamp base according to claim 1, wherein the high voltage-carrying components are embedded in an electrically insulating casting compound.

5. The gas discharge lamp base according to claim 1, wherein the carrier part is made of an electrically insulating plastic.

6. The gas discharge lamp base according to claim 1, wherein the electric contacts inside the gas discharge lamp base are designed according to the lead-frame technology.

7. The gas discharge lamp base according to claim 6, wherein the carrier part is provided with compartments for metallic insert parts, which form at least a part of the lead frame.

8. The gas discharge lamp base according to claim 1, wherein the carrier part is provided with a collar space, which serves to accommodate a connecting cable plug.

9. The gas discharge lamp base according to claim 1, wherein a housing top part on which the gas discharge lamp is mounted and sits on the second side of the carrier part, wherein the housing top part has bushings for a current lead-in wire and a current return wire and also electrically insulating webs arranged between the bushings, and wherein the carrier part has receptacles for the bushings and the insulating webs of the housing top part which are designed so that a labyrinth, for any creep currents that might occur, is formed by the housing top part joined to the carrier part.

10. The gas discharge lamp base according to claim 9, wherein the carrier part and the housing top part are locked together by means of catches.

11. The gas discharge lamp base according to claim 9, wherein the housing top part comprises an electrically insulating plastic.

12. The gas discharge lamp base according to claim 1, wherein a housing bottom part, which sits on the first side of the carrier part, is provided with electrically insulating webs which engage in corresponding receptacles of the carrier part.

13. The gas discharge lamp base according to claim 10, wherein the housing bottom part comprises an electrically insulating plastic.

14. The gas discharge lamp base according to claim 13, wherein the housing top part is provided with integrally molded pins or lugs, which run in guide grooves along the carrier part and are welded or soldered to the housing bottom part.

15. The gas discharge lamp base according to claim 12, wherein the housing bottom part has a closed outer contour.

16. The gas discharge lamp base according to claim 1, wherein a planar lead frame, with plastic sheathed circuit board conductors, carries the low voltage-carrying components, where the terminals of the components are connected to the circuit board conductors of the conductor frame.

17. The gas discharge lamp base according to claim 16, wherein metal tubes whose low voltage ends each contact one of the circuit board conductors of the lead frame are molded in the bottom of the carrier part separating the two sides as a bushing for the connecting wires leading from the high voltage side of the carrier part to the low voltage side.

18. The gas discharge lamp base according to claim 17, wherein the metal tubes are widened in a funnel shape on the end facing the high voltage end.

19. The gas discharge lamp base according to claim 18, wherein the low voltage ends of the metal tubes are inserted into holes in the circuit board conductors, whose edge protrudes in a funnel shape to the side facing away from the high voltage side.

20. The gas discharge lamp base according to claim 19, wherein the low voltage ends of the metal tubes are welded after insertion into the holes in the circuit board conductors of the lead frame and after insertion of the connecting wires into the metal tubes.

21. The gas discharge lamp base according to claim 1, wherein a metal housing encloses the gas discharge lamp base.

22. A gas discharge lamp base comprising:

a carrier part having a high voltage side and a low voltage side, wherein said high voltage side and low voltage side are substantially electrically insulated from one another aside from predetermined electrical connections, wherein said high voltage side contains high voltage components, said high voltage components comprising an interference suppression coil and a high voltage capacitor, and wherein said low voltage side contains low voltage components, said low voltage components comprising a starting capacitor and an ohmic resistor.

23. The gas discharge lamp base according to claim 22, wherein said high voltage side components further comprises a starting transformer.

24. The gas discharge lamp base according to claim 22, wherein said low voltage side components further comprises a spark gap and an interference suppression capacitor.

25. The gas discharge lamp base according to claim 22, wherein said carrier part adaptively receives a housing bottom part on the high voltage side.

26. The gas discharge lamp base according to claim 22, wherein said carrier part adaptively receives a housing top part on the low voltage side.

27. The gas discharge lamp base according to claim 22, wherein said carrier part is electrically connected to a gas discharge lamp.

* * * * *